US010591146B1

(12) United States Patent
Berry

(10) Patent No.: US 10,591,146 B1
(45) Date of Patent: Mar. 17, 2020

(54) LUMINAIRE MOUNTING ASSEMBLY

(71) Applicant: Joshua S. Berry, Fayetteville, AR (US)

(72) Inventor: Joshua S. Berry, Fayetteville, AR (US)

( * ) Notice: Subject to any disclaimer, the term of this patent is extended or adjusted under 35 U.S.C. 154(b) by 0 days.

(21) Appl. No.: 16/231,670

(22) Filed: Dec. 24, 2018

Related U.S. Application Data

(60) Provisional application No. 62/610,441, filed on Dec. 26, 2017.

(51) Int. Cl.

| | |
|---|---|
| ***F21V 21/04*** | (2006.01) |
| ***F21V 21/14*** | (2006.01) |
| ***E04B 9/00*** | (2006.01) |
| ***E04B 9/06*** | (2006.01) |
| *F21Y 115/10* | (2016.01) |
| *F21S 8/02* | (2006.01) |

(52) U.S. Cl.
CPC ..... *F21V 21/047* (2013.01); *E04B 9/006* (2013.01); *F21V 21/14* (2013.01); *E04B 9/06* (2013.01); *F21S 8/026* (2013.01); *F21Y 2115/10* (2016.08)

(58) Field of Classification Search
CPC ..... F21V 21/047; F21V 21/14; E04B 9/003; E04B 9/06; E04B 9/006; F21S 8/026
See application file for complete search history.

(56) References Cited

U.S. PATENT DOCUMENTS 5,516,068 A * 5/1996 Rice ..... H02G 3/20 248/300
5,618,017 A * 4/1997 De Boer ..... E04B 9/006 248/201
6,209,836 B1 4/2001 Swanson
7,271,335 B2 * 9/2007 Dinh ..... H02G 3/125 174/50
7,401,681 B2 * 7/2008 Iwayama ..... H04R 1/025 181/150
7,513,639 B2 4/2009 Wang
7,643,647 B2 1/2010 Lowell et al.
8,079,556 B2 12/2011 Fryzek et al.
8,905,583 B2 12/2014 Dubord
9,004,718 B2 4/2015 Myers et al.
9,220,178 B2 12/2015 O'Connor et al.
9,447,917 B1 9/2016 Wronski et al.
9,706,277 B2 7/2017 Tracy
2007/0285949 A1 12/2007 Lodhie et al.
2009/0290361 A1 11/2009 Ruud et al.
2010/0176138 A1 * 7/2010 Zacharevitz ..... H02G 1/00 220/737

(Continued)

*Primary Examiner* — Mariceli Santiago
(74) *Attorney, Agent, or Firm* — Goldstein Law Offices, P.C.

(57) ABSTRACT

A luminaire mounting assembly for mounting a LED light fixture to a pair of support beams. The luminaire mounting assembly includes an elongated plate and a movable plate. The elongated plate includes opposed sides and a flange extending from each of the opposed sides. The side walls and flanges define parallel tracks therebetween. The movable plate includes having a mounting hole and is adapted to slidably engage each of the parallel tracks. A knockout plate spans the mounting hole and is removably connected to the movable plate via a breakable member. Once the movable plate is suitably positioned and the mounting assembly is fastened to the support beams, the knockout plate is removed and the mounting hole is ready to receive the thin LED light fixture.

12 Claims, 7 Drawing Sheets

(56) References Cited

U.S. PATENT DOCUMENTS

| | | | | |
|---|---|---|---|---|
| 2010/0284185 | A1 | 11/2010 | Ngai | |
| 2011/0228543 | A1* | 9/2011 | Fryzek | F21V 21/048<br>362/365 |
| 2013/0286667 | A1 | 10/2013 | Sampsell et al. | |

* cited by examiner

LUMINAIRE MOUNTING ASSEMBLY

CROSS REFERENCES AND RELATED SUBJECT MATTER

This application is a non-provisional of provisional patent application Ser. No. 62/610,441, filed in the United States Patent Office on Dec. 26, 2017, from which priority is claimed and which is incorporated by reference herein in its entirety.

TECHNICAL FIELD

The present disclosure relates generally to a luminaire mounting assembly. More particularly, the present disclosure relates to a luminaire mounting assembly that facilitates mounting the luminaire in nearly any position with respect to a support beam.

BACKGROUND

Luminaires, generally understood to incorporate electric light units, are used to distribute light to selective areas. Such luminaires include those that are stand alone units, such as lamps, which are independently positionable relative to a support structure, and those that are installed units, such as light fixtures, which are fixedly secured to the support structure.

Most commonly among installed units—especially in newly constructed buildings and remodels—are recessed lighting fixtures, commonly known as "hi-hat" or "can" lights. Such lighting fixtures rely on the space between ceiling joists—commonly known as "bays" for accommodating the lighting can. Unfortunately, this scheme limits the location where a light can be placed significantly. In particular, such recessed lights can only be positioned within the bay. It is fundamental that a recessed light cannot be placed at the same location as a joist. Best that can be done in such circumstances is to 'snug' the light up against the joist. Since lighting design does not typically anticipate the location of ceiling joists, this constraint can easily foil plans for aesthetically pleasing lighting design. Because of an unfortunately located ceiling joist, for example, at times symmetry is lost and alignment of a series of lighting fixtures cannot be attained.

Incandescent bulbs and fluorescent lighting fixtures are rapidly being replaced by LED fixtures. Such fixtures are much more efficient than incandescent bulbs, provide better lighting than fluorescent fixtures, and last much longer than either. Recently, LED light fixtures have become available that are meant to either retrofit existing can lighting systems, or be installed in its stead. While such fixtures offer tremendous possibilities for new construction, few solutions have been provided to effectively mount them or to simplify installation when numerous units are being installed by an electrician.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a mount for a luminaire that can be fastened to a pair of support beams. Accordingly, the present disclosure provides a mounting assembly having an elongated plate having a longitudinal length greater than a distance between a pair of support beams that is configured to receive a fastener for securing to an outer surface of one of the support beams. The mounting assembly also includes a movable plate assembly including mount defined by an aperture sized and shaped to receive the luminaire.

Another aspect of an example embodiment in the present disclosure is to provide a mount that provides flexible positioning of the luminaire. Accordingly, the present disclosure provides an elongated plate including opposed sides having flanges extending therefrom defining parallel tracks, wherein the movable plate assembly adapted to slide along the parallel tracks to nearly any position along the longitudinal length of the elongated plate.

Yet another aspect of an example embodiment of the present disclosure is to provide a mechanism for precisely aligning the mount with a desired position for a luminaire. Accordingly, the movable plate has a mounting hole, and a knockout plate the removably spans the mounting hole. The knockout further includes an alignment point indicating a central position of the knockout and mounting hole. The alignment hole can be used with a laser alignment device to position the mounting hole at an exactly desired position for the eventual luminaire. Once suitably positioned, a breakable member connecting the mount with the knockout allows the knockout plate to be removed.

Still another aspect of an example embodiment of the present disclosure is to provide a movable mount that is fixable in a desired position. Accordingly, the present disclosure provides a flange defining a track adapted to receive a movable plate having a mount, wherein the flange is compressible between a first position and a second position intersecting the track and locking the movable plate. Additionally, the movable plate can be configured to be pierceable by a fastener for tacking directly to one of the support beams.

A further aspect of an example embodiment of the present disclosure is to provide a mechanism for fastening a luminaire mounting assembly to a support beam. Accordingly, the present disclosure provides an elongated plate adapted to extend across a support beam, wherein the elongated plate includes a slot adapted to receive a fastener therethrough.

A still further aspect of an example embodiment of the present disclosure is to provide a method for installing a luminaire. Accordingly, installation of the device as described in the present disclosure may comprise the steps of: (1) positioning an indicator for generating a marker indicating a center of a desired position of the luminaire; (2) positioning a rear side of an elongated plate of a luminaire mounting assembly having the elongated plate and a movable plate assembly against a pair of support beams; (3) aligning the alignment point of the knockout plate with the marker; (4) fastening the elongated plate to the pair of support beams; (5) fastening the movable plate to the elongated plate; (6) removing the knockout plate; and (7) inserting the luminaire into an opening formed after removing the knockout plate.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

FIGS. 1-6 illustrate an example embodiment of a luminaire mounting assembly 10 adapted to facilitate mounting a luminaire 14, such as an ultra-thin LED light, to a support structure, The support structure is generally a dwelling having framing that includes support beams 12 such as ceiling joists that each have an outer surface 12A. In the case of ceiling joists as the support beams 12, the outer surface 12A may be considered to be a bottom surface of said joists. The support beams 12 generally extend substantially parallel to each other and are separated by a spacing distance (D). The outer surfaces 12A of adjacent support beams 12 are generally co-planar such that a flat object can be placed flush against the outer surfaces 12A of said support beams 12 and extend substantially parallel thereto. Specifically, the luminaire mounting assembly 10 is adapted to mount to the outer surfaces 12A of a pair of the support beams 12 and to receive the luminaire 14 for mounting the luminaire 14 to said support beams 12. As will be described in further detail hereinbelow, the mounting assembly 10 can be mounted in nearly any lateral or longitudinal position with respect to the support beams 12 such that through use of the mounting assembly 10 the location of the support beams 12 do not limit the ultimate positioning of the luminaire 14. In an example embodiment, the luminaire mounting assembly 10 is further configured to be used in conjunction with a wall board 16, such as drywall, for forming an interior wall surface (e.g. ceiling) of the support structure. The use of support beams and wall boards are well known in the art and do not necessitate extensive discussion for purposes of this disclosure.

Figure 4A:
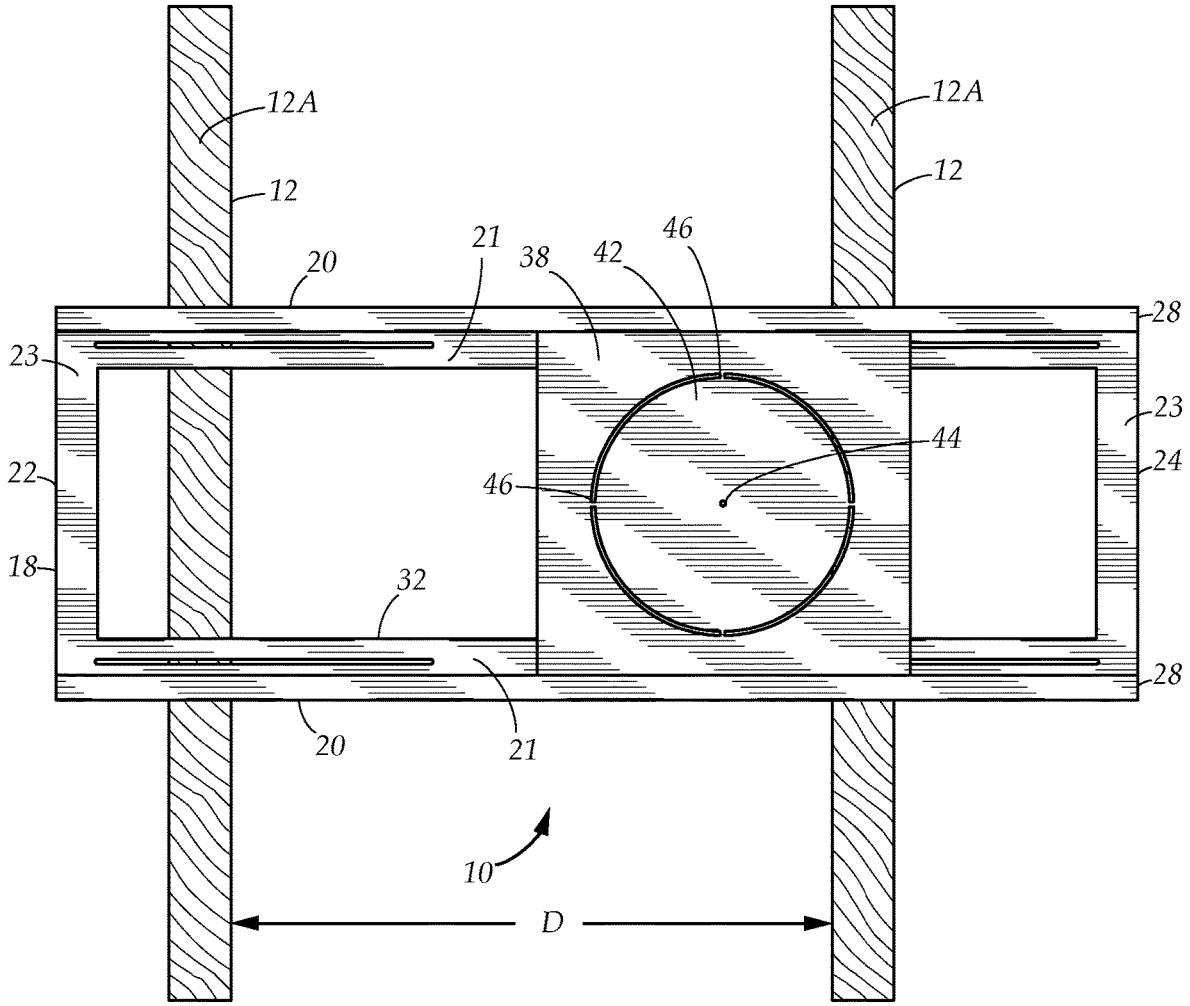
FIG. 4A is a top plan view of the luminaire mounting assembly of FIG. 1 positioned against a pair of support beams and having a movable mount assembly in a first position.

In an example embodiment, the luminaire mounting assembly 10 includes an elongated plate 18 and a movable plate assembly 30. As seen in FIG. 4A, The elongated plate 18 is adapted to secure to the pair of support beams 12. Now referring to FIGS. 1 and 4A, the elongated plate 18 is formed as a substantially planar unitary member having a first end 22, a second end 24 opposite the first end 22, and opposed sides 20 that extend between the first end 22 and the second end 24. The elongated plate 18 includes a pair of side borders 21 along the opposed sides 20, and a pair of end borders 23 at the first end 22 and second end 24. The opposed sides 20, and end borders 23 are coplanar and together define an aperture 32. In an example embodiment, the elongated plate 18 is a substantially rectangular plate, and the aperture 32 is substantially rectangular. It is appreciated, however, that the elongated plate can be other shapes while retaining other functional structures described herein. Additionally, the elongated plate 18 has a longitudinal length ($L_{EP}$) greater than a distance (D) between the pair of support beams 12 so that the elongated plate 18 is adapted to be positioned against the outer surfaces 12A of the pair of support beams 12.

Figure 1:
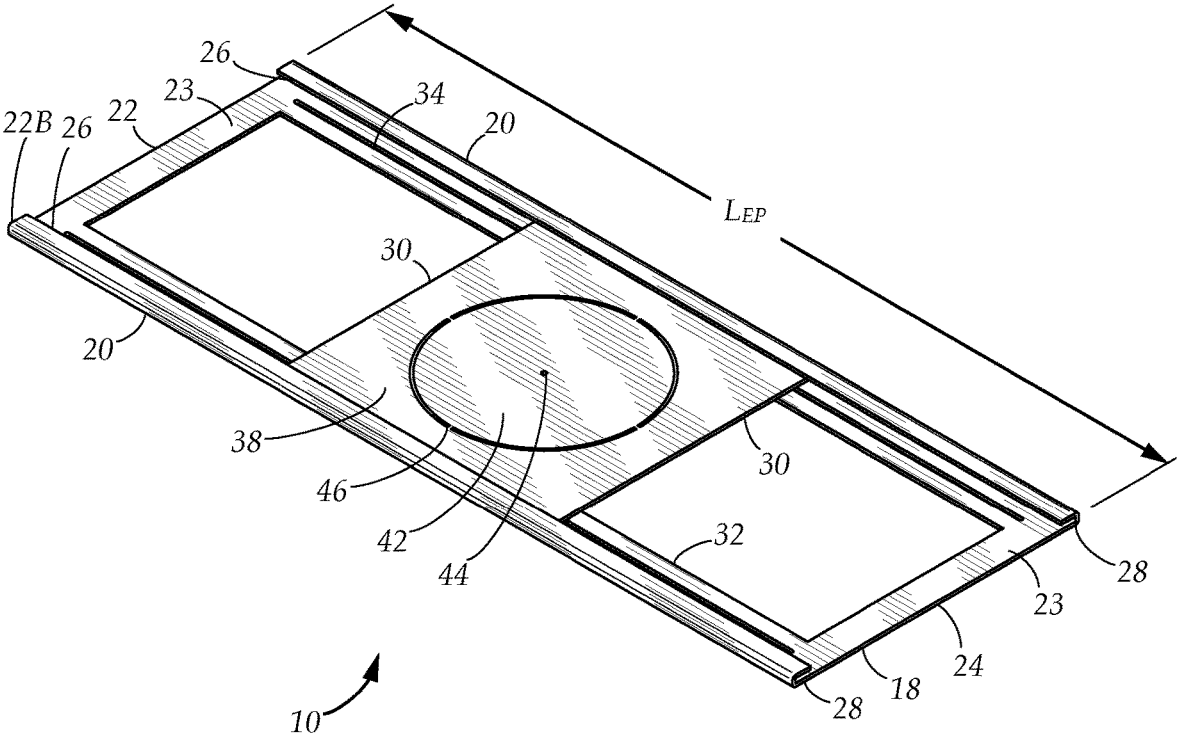
FIG. 1 is a perspective view of a luminaire mounting assembly of an example embodiment of the present disclosure.
Figure 3:
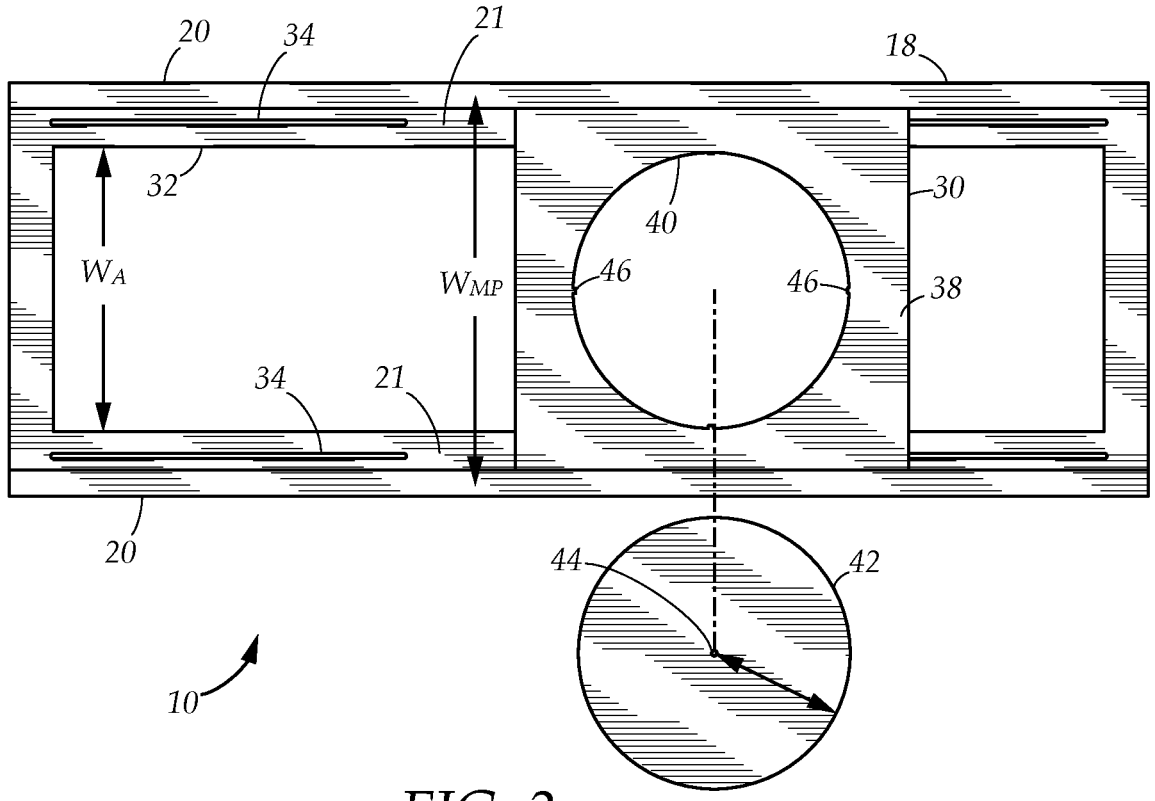
FIG. 3 is a top plan view of the luminaire mounting assembly of FIG. 1 with a knockout separated for illustrative purposes only.
Figure 5:
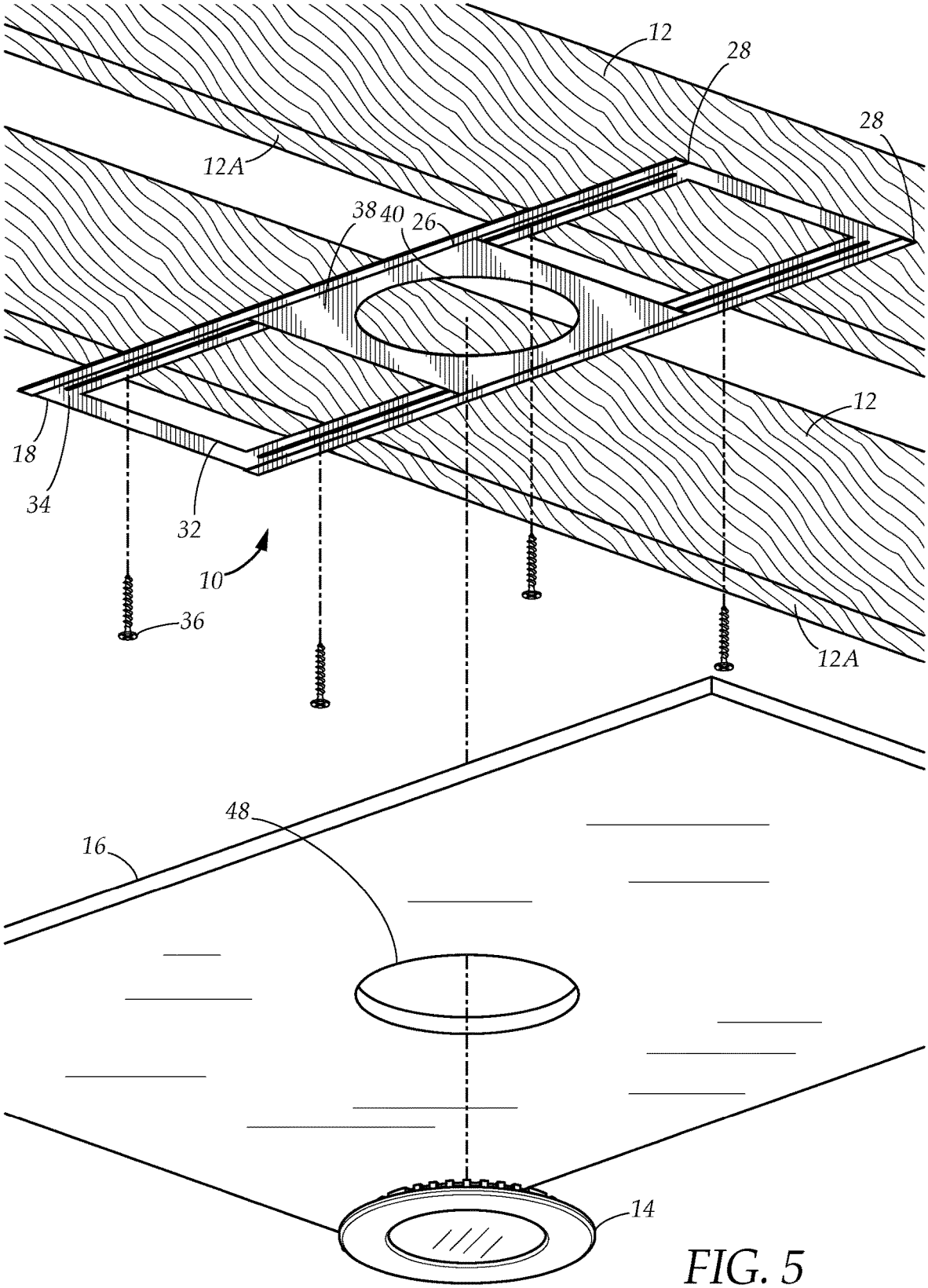
FIG. 5 is a partially exploded perspective view of a luminaire mounting assembly and luminaire in accordance with an example embodiment of the present disclosure.

As best shown in FIGS. 1, 3, and 5, in order to facilitate securing the elongated plate 18 to the outer surfaces 12A of the pair of support beams 12, the elongated plate 18 may further include one or more slots 34 along the elongated plate 18. The slots 34 are configured to receive a fastener 36, such as a screw, adapted to fixedly secure to the outer surface 12A of one of the pair of support beams 12. The slots 34 may be formed as elongated apertures in the side borders 21, extending substantially parallel to the sides 20 as illustrated. In an example embodiment, the slots 34 are spaced near between the opposed sides 20 and the aperture 32. Furthermore, the slots 34 may extend along the opposed sides 20. It is appreciated, however, that the slots 34 may be elongated slots extending parallel and along a majority of the opposed sides 20 or may be a plurality of slots interspersed along the opposed sides 20.

Figure 2:
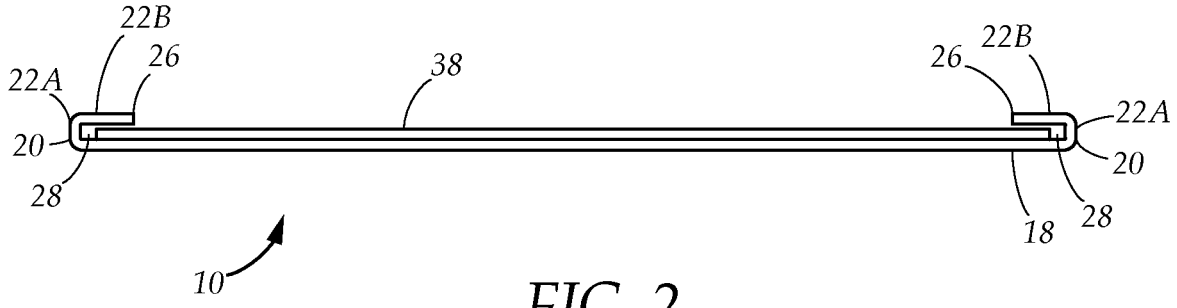
FIG. 2 is a front side view of the luminaire mounting assembly of FIG. 1.

The elongated plate 18 is further adapted to slidably receive the movable plate assembly 30. As best shown in FIG. 1 and FIG. 2, the elongated plate 18 includes flanges 26 extending inwardly toward the aperture 32 along each of the opposed sides 20. The flanges 26 include a first leg 22A extending from one of the opposed sides 20, substantially normal to the side border 21, and a second leg 22B continuing from the first leg 22A and extending parallel to the respective side border 21 inwardly toward the aperture 32 and away from the opposed side 20. The second legs 22B of the flanges 26 are separated by a flange distance. The flanges 26 may be part of the same piece of material as the rest of the elongated plate 18, formed by one hundred-eighty degree bends along each of the opposed sides 20. Constructed as such, the side borders 21 and flanges 26 form a space therebetween defining a pair of parallel tracks 28. The parallel tracks 28 extend completely along the longitudinal length ($L_{EP}$) of the elongated plate 18 and, as seen in FIG. 2, are adapted to slidably receive the movable plate assembly 30 such that the movable plate assembly can move fully between the first end 22 and second end 24 within the parallel tracks 28, held in placed by the flanges 26.

Additionally, as best shown in FIG. 3, the aperture 32 is sized to have a width ($W_A$) less than a width ($W_{MP}$) of the movable plate assembly. As such, the elongated plate 18 is adapted to form a substantially planar surface on which the movable plate assembly 30 slides therein. In addition, the flange distance is less than the width ($W_{MP}$) of the movable plate assembly. It should be noted that the elongated plate 18 and movable plate assembly 30 are preferably fabricated using thin sheet metal. For the sake of illustration clarity, however, thicknesses of the elongated plated 18, movable plate assembly 30 and the tracks 28 have been somewhat exaggerated in the drawing figures, as they might otherwise be too thin to illustrate properly if drawn to scale. It should also be noted that the aperture 32 can have any shape as desired, including rectangular, oval, circular, a plurality of spaced apart apertures, and so forth.

Figure 4B:
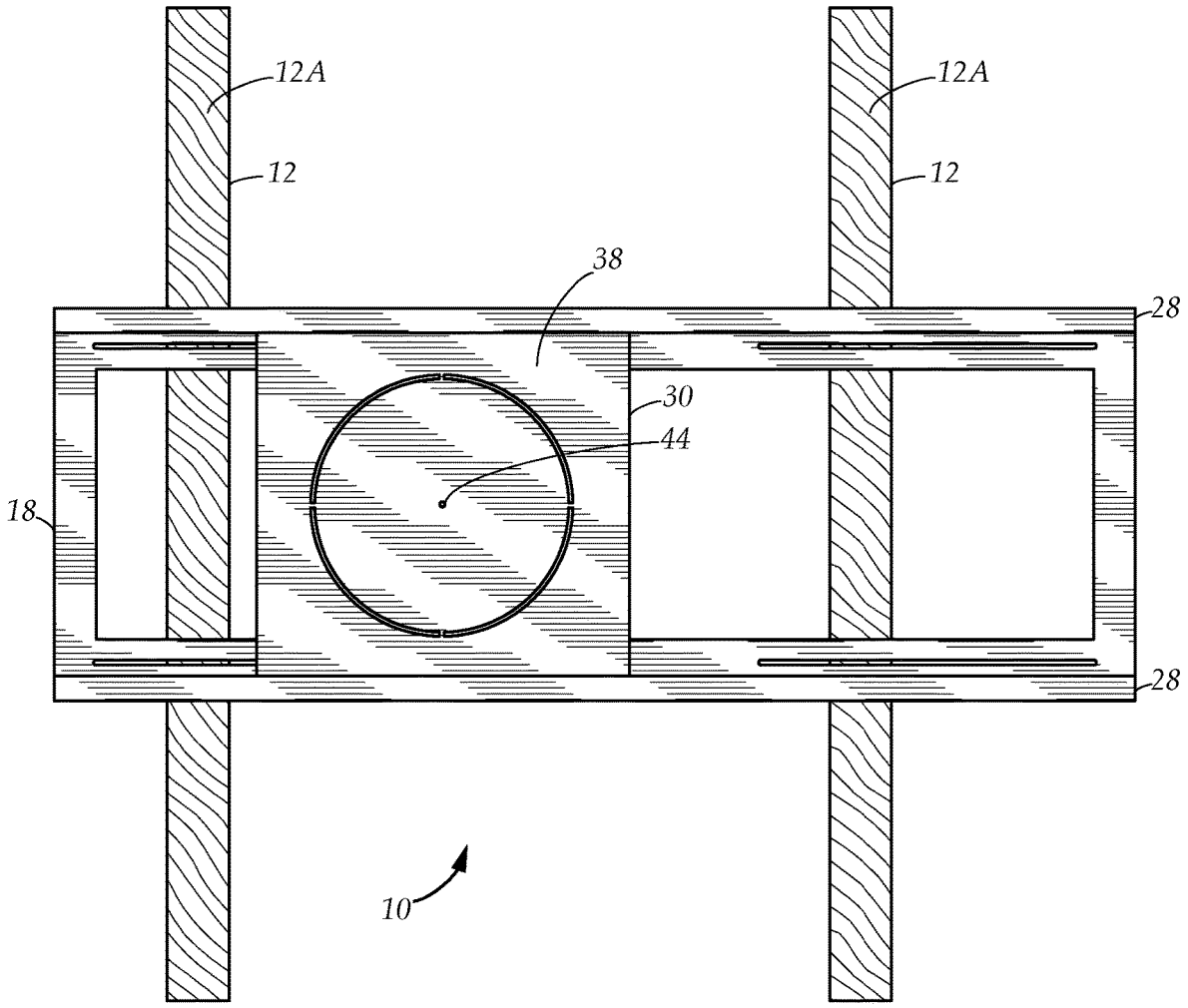
FIG. 4B is a top plan view of the luminaire mounting assembly of FIG. 4A having the movable mount in a second position.
Figure 4C:
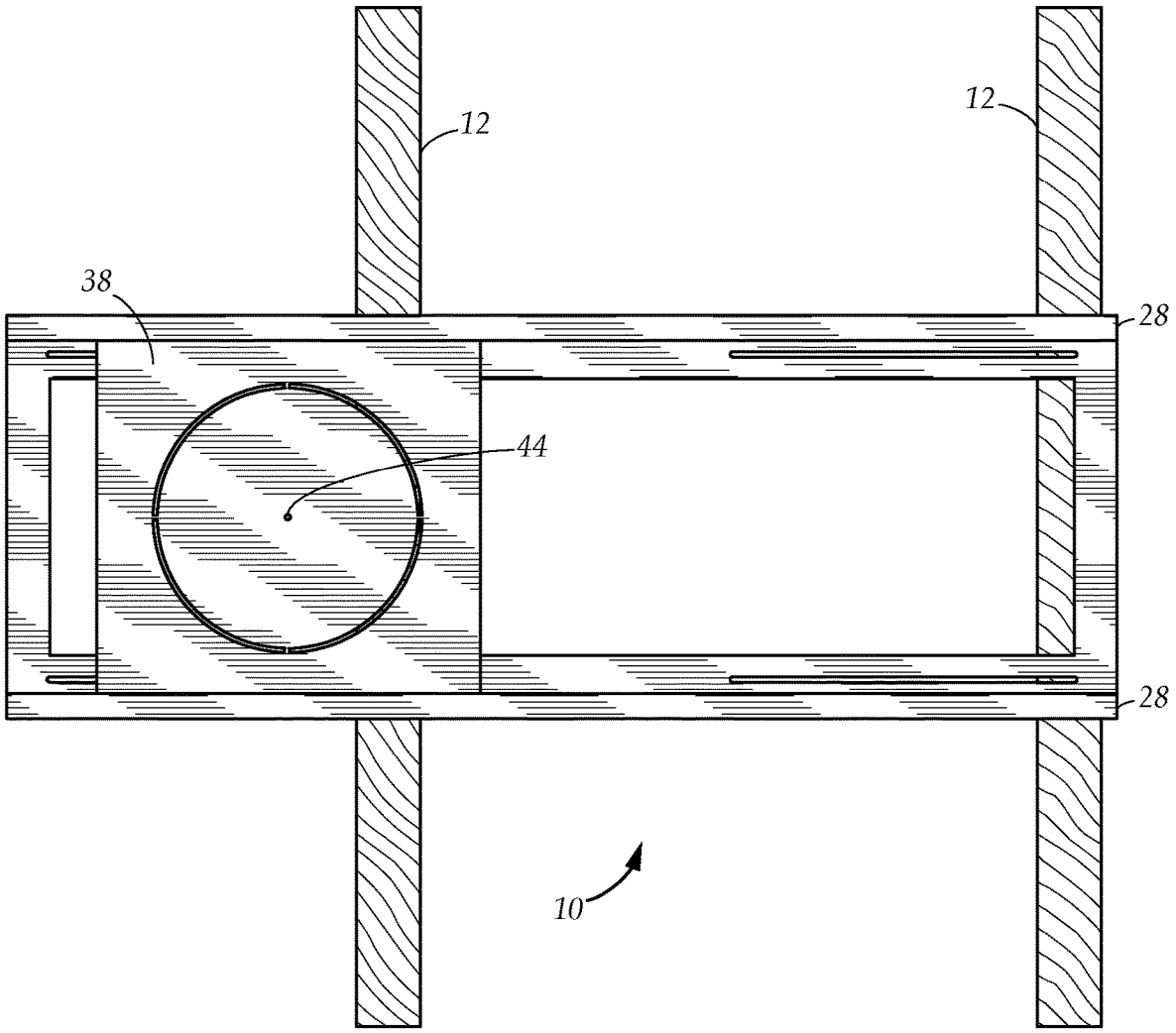
FIG. 4C is a top plan view of the luminaire mounting assembly of FIG. 1 positioned against a pair of support beams.

The movable plate assembly 30 is adapted to slidably engage the elongated plate 18. Specifically, as best shown in FIG. 1, the movable plate assembly 30 includes a movable plate 38 formed as a substantially planar unitary member extending between and engaging the parallel tracks 28, although part of the movable plate 38 is obscured in FIG. 1 by the second leg 22B. As best shown in FIGS. 4A-4C, in an example embodiment, the movable plate 38 can slide completely along the parallel tracks 28 at any suitable position between the first end 22 and second end 24, and most importantly, the mounting assembly can be permanently affixed to the support beams 12 in any of these positions for the subsequent mounting of the luminaire. Additionally, as best shown in FIG. 1, the elongated plate 18 is configured such that the movable plate 38 can enter and exit the parallel tracks 28 at one of the first or second ends 22, 24.

Additionally, as best shown in FIGS. 3 and 5, the movable plate assembly 30 includes a mounting hole 40 defined as an opening on the movable plate 38 for fixidly receiving the luminaire 14. As such, the mounting hole 40 is sized and shaped to receive a luminaire 14 with a clearance fit. In an example embodiment, the luminaire 14 is an ultra-thin LED light, which is generally circular, and thus the mounting hole 40 is generally circular.

As best shown in FIGS. 1 and 3, the movable plate assembly 30 may further include a knockout plate 42 for facilitating the positioning and installation of the luminaire 14 (not shown). The knockout plate 42 is sized and shaped to substantially span the mounting hole 40. In an example embodiment, the knockout plate 42 may further include an alignment point 44 for indicating a center of the knockout plate 42. The alignment point 44 may be formed of an indent, of a visible mark, or a hole, and so forth on the knockout plate 42. It is appreciated that because the knockout plate 42 is positioned inside the mounting hole 40, the alignment point 44 also indicates a center of the mounting hole 40.

Additionally, in an example embodiment, the knockout plate 42 is adapted to be removable by a user after positioning the mounting hole 40 in a desired position along the elongated plate 18. As best shown in FIGS. 1, 3 and 4A, the knockout plate 42 is removably connected to the movable plate 38 via one or more breakable members 46. In an example embodiment, the breakable members 46 are formed as part of a plurality of perforations that circumscribe the knockout plate 42 and define the mounting hole 40.

With reference generally to FIGS. 1-6, is appreciated therefore that the above described structure provides a luminaire mounting assembly 10 that allows a user to selectively position the luminaire 14. Specifically, the elongated plate 18 is adapted to be secured to the outer surface 12A of a pair of support beams 12 thereby allowing the to-be-installed luminaire 14 to be positioned in any position with respect to the support beams 12, including directly against one of the support beams 12. Additionally, the movable plate assembly 30 is slidable along the parallel tracks 28 allowing for selectively positioning the mounting hole 40, and consequently the to-be-installed luminaire 14, at any position along the entire longitudinal length ($L_{EP}$) of the elongated plate 18.

In an example method, a user installs a luminaire 14 as described below.

Initially, after determining a desired location for a luminaire 14, the user indicates a central point of the desired location in proximity to the support beams 12 via an indicator, such as laser positioned on a floor surface directly below that desired location, with the laser pointed upwardly. Then, as shown generally in FIGS. 4A, 4B, 4C, and 5, the user positions the elongated plate 18 against the outer edges 12A of a pair of support beams 12 and aligns the movable plate assembly 30 with the central point indicated by the indicator. Specifically, the user aligns the alignment point 44 of the knockout 42 with the central point indicated by the indicator.

Next, referring to FIG. 5, the user fastens the elongated plate 18 to the support beams 12 via fasteners 36. Specifically, the fasteners 36 are inserted through the slots 34 and into the outer surfaces 12A of the support beams 12. It is appreciated that to overcome the instances where the movable plate 38 overlaps with the slots 34, the movable plate 38 may be formed of a material pierceable by the fasteners 36, such as galvanized steel. In addition, it should be noted that although the examples herein show and describe attaching the elongated plate 18 to two adjacent support beams 12, in some installations it may be desirable or necessary to attach the plate 18 to only one support beam 12. Ultimately, the mounting assembly may be considered a 'place holder' while wiring and finishing the dwelling or structure, including serving as a template when cutting a wall board for installation at the location of the luminaire. Considering the light weight of typical LED luminaires and that such luminaires will ultimately be supported by the wall panels, the plate 18 does not and need not provide actual structural support for the luminaire.

Then, the user secures the movable plate 38 to the elongated plate 18. In an example embodiment, the movable plate 38 can be secured to the elongated plate 18 in at least one of two ways. Specifically, the flanges 26 of the elongated plate 18 may be adapted to be compressed inwardly towards the space defined between the elongated plate 18 and flanges 26, i.e., the parallel tracks 28. As such, the parallel tracks 28 can either be deformed adjacent to the movable plate 38 for forming a blockage preventing the movable plate 38 from moving, or deformed onto the movable plate 38 for fixidly securing the movable plate 38 through friction. Additionally, if and/or when the movable plate 38 overlaps with a support beam 12, the movable plate 38 may be fastened directly to the support beam by being pierced by the fastener 36, as described above.

Next, the user removes the knockout plate 42 (not seen in FIG. 5) from the mounting hole 40. Specifically, the user breaks the breakable members 46 (not seen in FIG. 5) to remove the knockout plate 42 and expose the mounting hole 40. In an example embodiment, the breakable members 46 are breakable through the application of user-generated force. However, it is appreciated that the breakable members 46 may also be breakable through the use of cutting tools. Additionally, it is appreciated that the aperture 32 of the elongated plate 18 may be sized and shaped such that the knockout plate 42 can be pushed upwards and through the aperture 32, to facilitate the removable of the knockout plate 42. With the mounting assembly 10 suitably positioned and fastened in place, electric wiring is done in the proximity of the mounting assembly 10 to be ready for eventual connection to the luminaire 14. Such wiring may include installation and securement of a low voltage transformer or other control circuitry to one of the support members 12.

Then, as best shown in FIG. 5, the wall board 16, such as drywall, may be positioned over the luminaire mounting assembly 10 and cut to have a wall opening 48 matching and aligned with the mounting hole 40 for receiving the luminaire 14. Referring now to both FIG. 5 and FIG. 6, electrical connectors 15 positioned above the luminaire mounting assembly 10 are connected to the luminaire 14 for providing power to the to-be-installed luminaire 14. Such use and application of wall boards and electrical connectors are well known in the art and do not require extensive discussion for purposes of this disclosure. Finally, the luminaire 14 is inserted through the wall opening 48 and mounting hole 40 for mounting therein, and then fastened and trimmed as appropriate to the luminaire 14.

Figure 6:
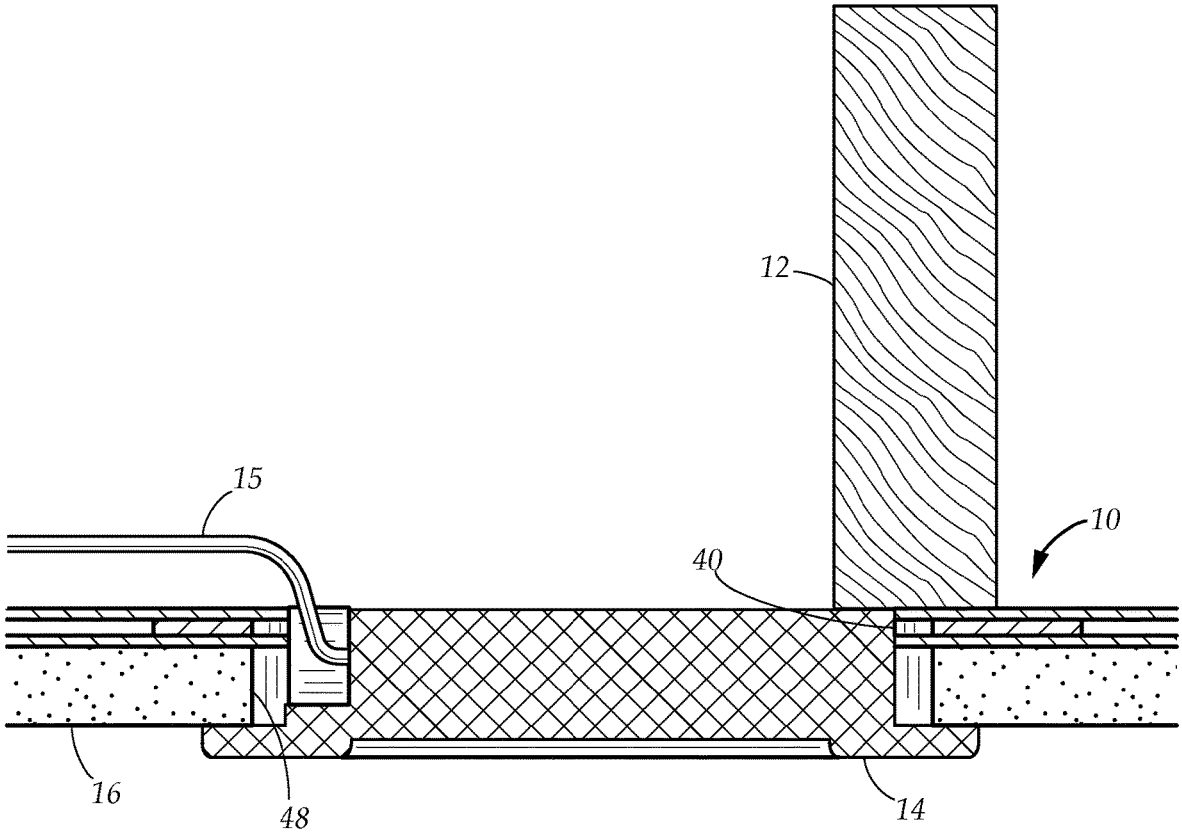
FIG. 6 is a partial front elevational view of the luminaire mounting assembly and luminaire of FIG. 5 assembled together, with parts broken away.

Referring to FIG. 6, it can be appreciated that the installation of the wall board 16 creates an extended passageway formed by the mounting hole 40 and opening 48. As such, a luminaire 14, such as an ultra-thin LED light, has sufficient space to fit therein even if it overlaps partially with one of the support beams 12.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a luminaire mounting assembly. The disclosure is illustrated by example in the drawing figures, and throughout the written description. It should be understood that numerous variations are possible, while adhering to the inventive concept. Such variations are contemplated as being a part of the present disclosure.

What is claimed is:

1. A luminaire mounting assembly, for use in a building having a pair of support beams, each of the support beams having an outer surface, to be covered with a sheet of wallboard, for securing a luminaire to the support beams and the sheet of wallboard, comprising:

an elongated plate for securing to the outer surface of the support beams, the elongated plate having a first end, a second end, and a pair of opposed sides, the elongated plate having a pair of parallel tracks extending along the opposed sides;

a movable plate extending between the parallel tracks such that the movable plate is adapted to slide between the first end and second end within said parallel tracks, the movable plate having a mounting hole adapted for receiving the luminaire.

2. The luminaire mounting assembly as recited in claim 1, wherein the elongated plate has a pair of side borders at the opposed sides and has a pair of end borders at the first and second end, the side borders and end borders together defining an aperture, the elongated plate also having flanges that extend inwardly from the opposed sides to partially overlap the side borders and define the tracks.

3. The luminaire mounting assembly as recited in claim 2, wherein the movable plate further comprises a knockout plate that substantially spans the mounting hole, the knockout plate is secured to the movable plate with breakable members that allow the knockout plate to be selectively removed, the knockout plate has a center and has an alignment point located at the center that is adapted for positioning the elongated plate and movable plate with respect to the support beams prior to removing the knockout plate.

4. The luminaire mounting assembly as recited in claim 3, wherein the elongated plate is substantially rectangular in shape, the aperture is substantially rectangular in shape, and the mounting hole is substantially circular in shape.

5. The luminaire mounting assembly as recited in claim 4, wherein each of the side borders has a slot that extends longitudinally partially between the first end and second end that is adapted to facilitate attachment of the elongated plate to the outer surfaces of the support beams.

6. The luminaire mounting assembly as recited in claim 5, wherein the elongated plate is a substantially unitary construction, made of a single piece of thin material, with the side borders and end borders substantially planar and with the flanges formed by a pair of one hundred-eighty degree bends along the opposed sides.

7. A luminaire mounting assembly, for use in a building having a pair of support beams, each of the support beams having an outer surface, to be covered with a sheet of wallboard, for securing a luminaire to the support beams and the sheet of wallboard, comprising:

an elongated plate for securing to the outer surface of the support beams, the elongated plate having a first end, a second end, and a pair of opposed sides, the elongated plate having a pair of flanges that define a pair of parallel tracks extending along the opposed sides, the flanges are separated by a flange distance;

a movable plate having a movable plate width that is greater that the flange distance, the movable plate mounted to extend between the parallel tracks such that the movable plate is adapted to slide between the first end and second end within said parallel tracks, the movable plate having a mounting hole adapted for receiving the luminaire.

8. The luminaire mounting assembly as recited in claim 7, wherein the elongated plate has a pair of side borders at the opposed sides and has a pair of end borders at the first and second end, the side borders and end borders together defining an aperture having an aperture width, the movable plate width is greater than the aperture width.

9. The luminaire mounting assembly as recited in claim 8, wherein the elongated plate is a substantially unitary construction, made of a single piece of thin material, with the side borders and end borders substantially planar and with the flanges formed by a pair of one hundred-eighty degree bends along the opposed sides.

10. The luminaire mounting assembly as recited in claim 9, wherein each of the side borders has a slot that extends longitudinally partially between the first end and second end that is adapted to facilitate attachment of the elongated plate to the outer surfaces of the support beams.

11. The luminaire mounting assembly as recited in claim 10, wherein the elongated plate is substantially rectangular in shape, the aperture is substantially rectangular in shape, and the mounting hole is substantially circular in shape.

12. The luminaire mounting assembly as recited in claim 11, wherein the movable plate further comprises a knockout plate that is circular in shape and substantially spans the mounting hole, the knockout plate is secured to the movable plate with breakable members that allow the knockout plate to be selectively removed, the knockout plate has a center and has an alignment point located at the center that is adapted for positioning the elongated plate and movable plate with respect to the support beams prior to removing the knockout plate.

* * * * *